US009150228B2

(12) United States Patent
Grappone

(10) Patent No.: US 9,150,228 B2
(45) Date of Patent: Oct. 6, 2015

(54) TRACK CIRCUIT PROVIDING ENHANCED BROKEN RAIL DETECTION

(71) Applicant: Grappone Technologies Inc., Hicksville, NY (US)

(72) Inventor: Victor F. Grappone, Hicksville, NY (US)

( * ) Notice: Subject to any disclaimer, the term of this patent is extended or adjusted under 35 U.S.C. 154(b) by 269 days.

(21) Appl. No.: 13/940,395

(22) Filed: Jul. 12, 2013

(65) Prior Publication Data

US 2014/0014782 A1 Jan. 16, 2014

Related U.S. Application Data

(60) Provisional application No. 61/671,301, filed on Jul. 13, 2012.

(51) Int. Cl.
*B61L 23/04* (2006.01)
*B61L 1/18* (2006.01)
*B61L 21/10* (2006.01)

(52) U.S. Cl.
CPC ..... *B61L 23/044* (2013.01); *B61L 1/185* (2013.01); *B61L 21/10* (2013.01)

(58) Field of Classification Search
CPC ..... B61L 23/044; B61L 1/181; B61L 3/221; B61L 1/18; B61L 23/00; B61L 23/04; B61L 23/042; B61L 1/185; B61L 21/10; B61K 9/10
USPC ..... 246/122 R, 34 CT, 63 C, 120, 28 F; 324/522, 713, 217
See application file for complete search history.

(56) References Cited

U.S. PATENT DOCUMENTS

| | | | | |
|---|---|---|---|---|
| 3,897,921 | A * | 8/1975 | West et al. | 246/34 CT |
| 4,022,408 | A * | 5/1977 | Staples | 246/34 R |
| 4,074,879 | A * | 2/1978 | Clark et al. | 246/37 |
| 4,117,529 | A * | 9/1978 | Stark et al. | 361/182 |
| 4,389,033 | A * | 6/1983 | Hardman | 246/37 |
| 5,145,131 | A * | 9/1992 | Franke | 246/122 R |
| 2014/0012438 | A1 * | 1/2014 | Shoppa et al. | 701/19 |

* cited by examiner

*Primary Examiner* — Mark Le
(74) *Attorney, Agent, or Firm* — Abelman, Frayne & Schwab

(57) ABSTRACT

A railroad track circuit providing for the positive detection of broken rails despite the presence of factors that would otherwise preclude such detection is disclosed. These factors include sneak paths arising from the presence of negative return cross-bonding as applied between parallel tracks in electrified territory. Broken rail detection is ensured through the provision of two track relays, or devices that function as track relays, uniquely arranged so as to render the track circuit immune from these factors.

6 Claims, 7 Drawing Sheets

TRACK CIRCUIT PROVIDING ENHANCED BROKEN RAIL DETECTION

CROSS-REFERENCE TO RELATED APPLICATIONS

This application is based on and claims priority to U.S. Provisional Patent Application No. 61/671,301, filed on Jul. 13, 2012, the disclosure of which is incorporated herein in its entirety by reference.

BACKGROUND OF THE INVENTION

The invention pertains to a railroad track circuit providing for the positive detection of broken rails despite the presence of factors that would otherwise preclude such detection. Prior art railroad track circuits that monitor for broken rails have been negatively affected by sneak paths that arise from the presence of negative return cross-bonding as applied between parallel tracks in electrified territory.

BRIEF SUMMARY OF THE INVENTION

The railroad track circuit of the present invention provides accurate broken rail detection, which is ensured through the provision of two track relays, or devices that function as track relays. These devices are uniquely arranged so as to render the track circuit immune from sneak paths that interfere with the function of the prior art track circuits.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION OF THE INVENTION

Figure 1:
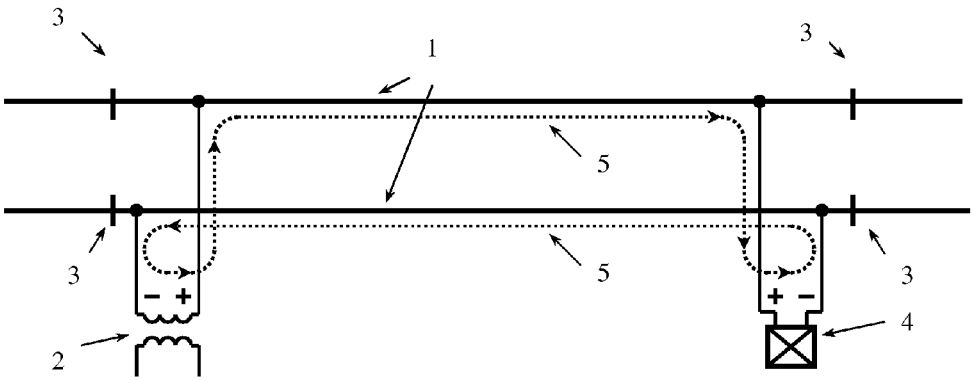
Figure 1 (Prior Art)
FIG. 1 shows a prior art arrangement and operation of a track circuit.

The track circuit was invented in the 1870's. Its function is to detect whether a defined length of track, or "block", is clear of trains, thereby allowing following trains to proceed safely at high speed. FIG. 1 illustrates a typical track circuit. A track circuit includes the two running rails 1. A local power supply feeds an energy source 2 connected to one end of a block isolated by insulated rail joints 3. A relay or equivalent device 4 is connected to the end opposite the energy source 2. Track circuit current 5 flows from the energy source 2 through the rails 1 to the track relay 4, thereby energizing it.

Figure 2:
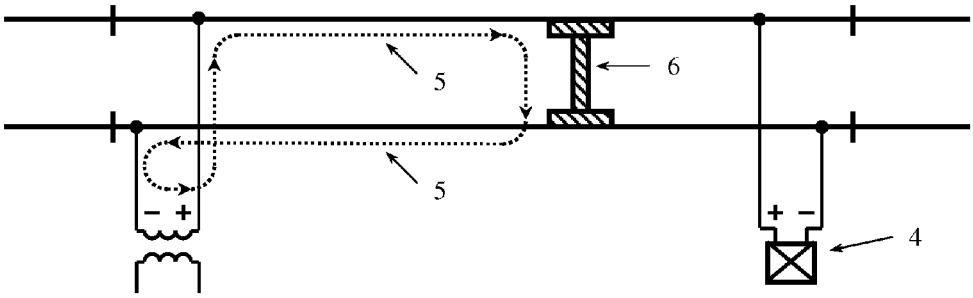
Figure 2 (Prior Art)
FIG. 2 shows a prior art de-energization of a track circuit due to the presence of a train.
Figure 3:
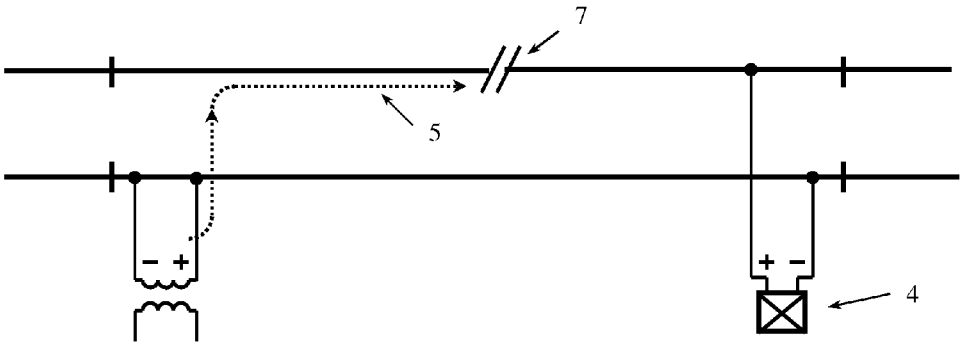
Figure 3 (Prior Art)
FIG. 3 shows a prior art de-energization of a track circuit due to the presence of a broken rail.

FIG. 2 illustrates track circuit operation in the presence of a train. The train wheels 6 short-circuit the current 5 away from the relay, thereby de-energizing it. FIG. 3 illustrates track circuit operation with a broken rail. The break 7 blocks the flow of current 5, thereby de-energizing the track relay 4. An energized track relay thereby ensures that the block is both clear of train and that it contains no broken rails. These conditions being met, safe train operations could be ensured.

Figure 4:
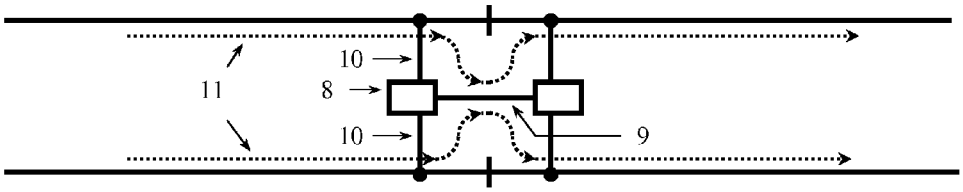
Figure 4 (Prior Art)
FIG. 4 shows the arrangement of impedance bonds and flow of traction return current in a prior art track circuit.
Figure 5:
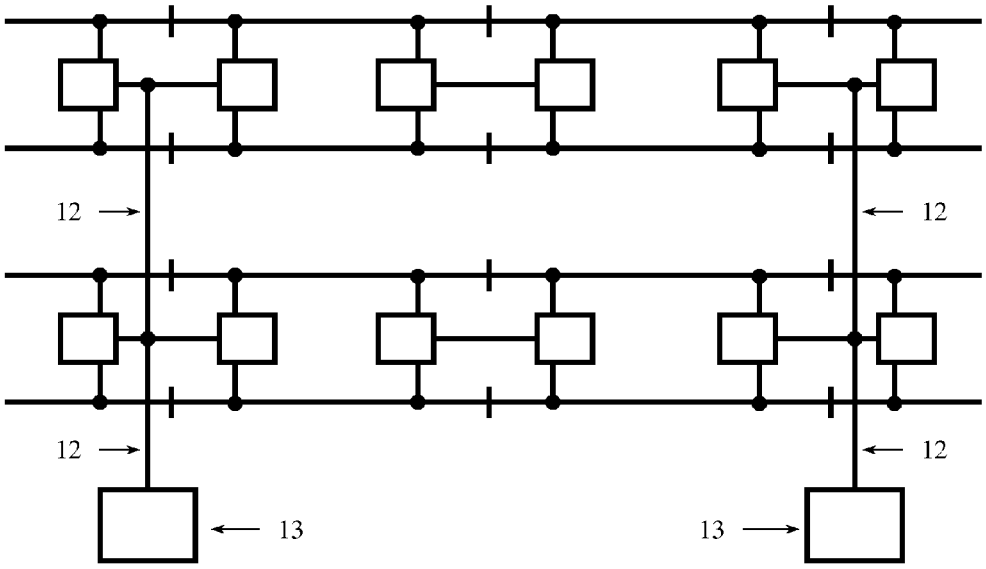
Figure 5 (Prior Art)
FIG. 5 shows a typical cross-bonding arrangement as applied in multiple-track territory per the prior art.
Figure 6:
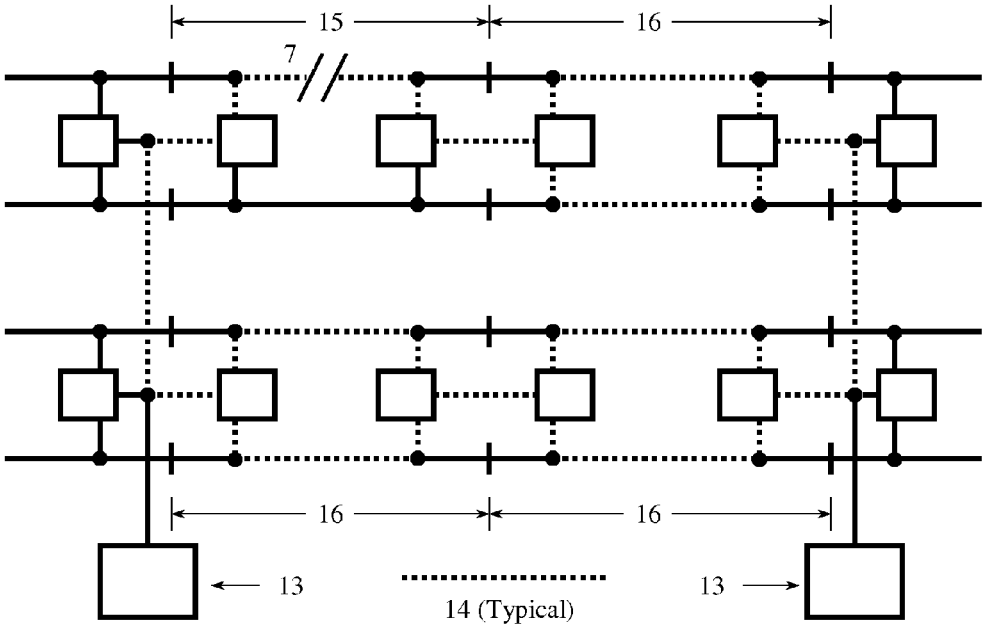
Figure 6 (Prior Art)
FIG. 6 shows sneak paths caused by cross bonding in multiple track territory per the prior art.
Figure 7:
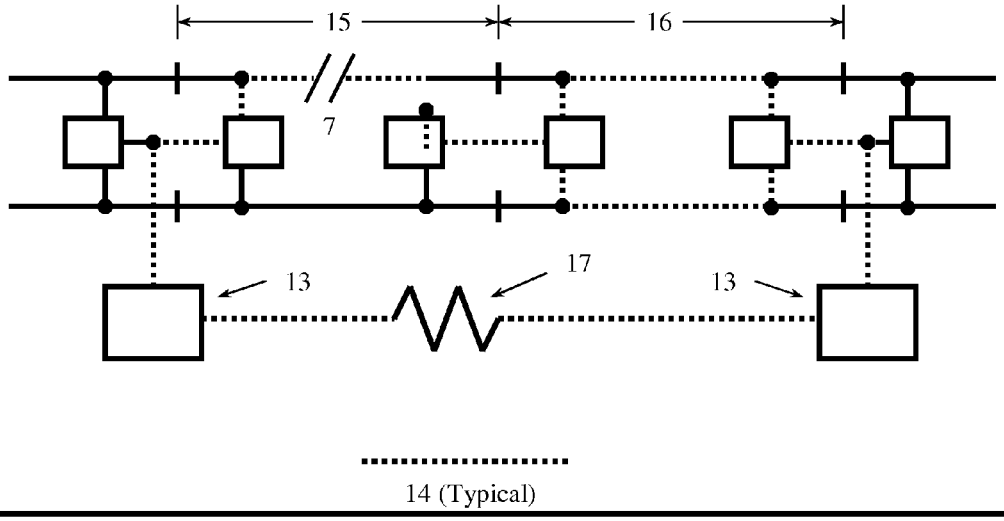
Figure 7 (Prior Art)
FIG. 7 shows sneak paths caused by grounding between adjacent power substations per the prior art.

The subsequent development of electric propulsion for trains presented complications for track circuits because the rails were now also required to provide a return path for propulsion current back to the substations. FIG. 4 depicts the provision of impedance bonds 8, an equalizer bar 9, and side leads 10 to provide such a path for the propulsion current 11 to return to the substation(s) that generated it. Impedance bonds typically consist of two concentrically but oppositely wound copper coils arranged so as to provide nearly zero impedance to the return propulsion current while presenting an impedance of several ohms from rail to rail. The impedance to the return current is near zero because the opposing orientation of the two windings effect a cancellation of the magnetic fields induced by the equal currents flowing in each. This is referred to as impedance bond "balance." The energy source 2 is adjusted so as to overcome the rail-to-rail impedance to a degree sufficient to energize the track relay.

Where there are multiple tracks or other complex track arrangements, the return paths must be interconnected via "cross-bonding." FIG. 5 illustrates the concept of cross-bonding in which the equalizer bars of two tracks are connected by cross bonds 12. The cross bonds 12 are, in turn, connected to the substations 13. The presence of cross bonds gives rise to a significant problem in connection with broken rail detection. This is because when a rail is broken, the combination of the cross bonds and parallel tracks comprise a "sneak path" whereby the track circuit energy effectively flows around the rail break rather than being blocked by it. FIG. 6 illustrates the sneak path 14. The current flows through the impedance bonds within the track circuit having the break 15, then through the impedance bonds of adjacent track circuits 16 and the cross bonds 12. Because this current flows through the impedance bonds of adjacent track circuits 15 in balanced mode, these impedance bonds present virtually no impedance to this current. Therefore, such a sneak path can exist even if many track circuits intervene between cross bonds 12. FIG. 7 illustrates a similar sneak path that may be caused by the ground impedance 17 between adjacent substations 13 which are intentionally grounded.

Figure 8:
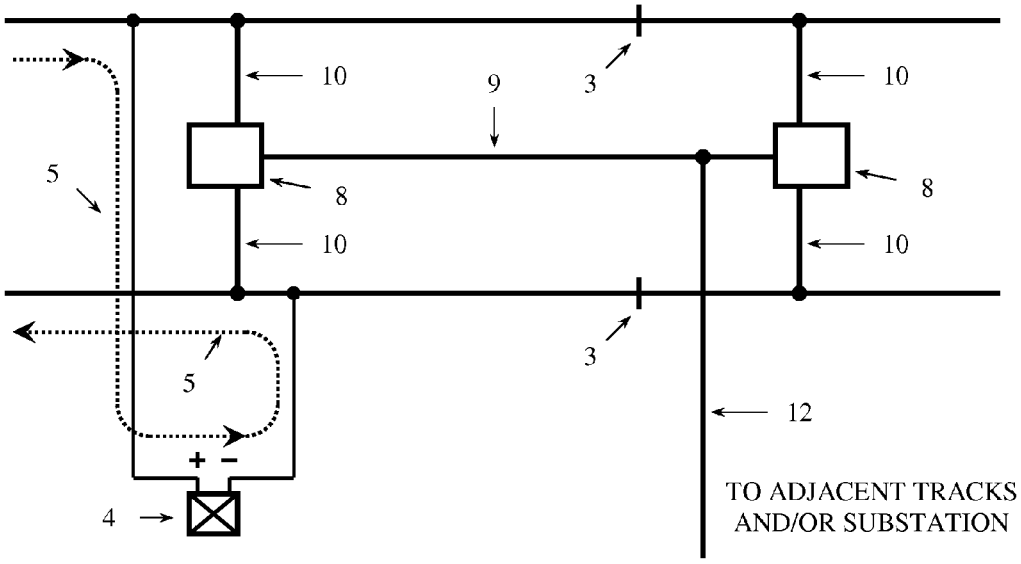
Figure 8 (Prior Art)
FIG. 8 shows the normal flow of current through a track relay per the prior art.
Figure 9:
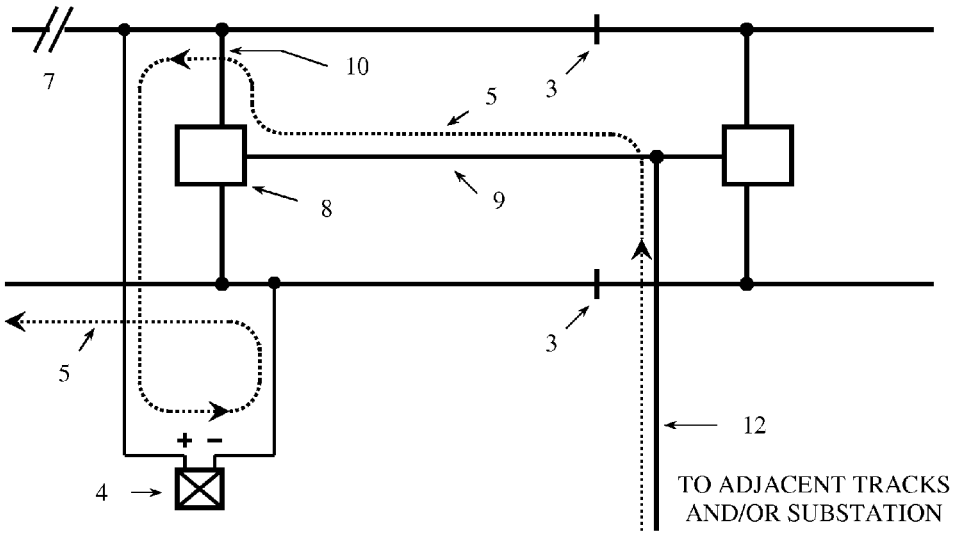
Figure 9 (Prior Art)
FIG. 9 shows the flow of current through a track relay in a track circuit with a broken rail via a sneak path per the prior art.

FIG. 8 details the flow of track circuit current 5 through the track relay 4 in an unoccupied track circuit in the absence of a broken rail, i.e., the normal condition. In contrast, FIG. 9 depicts the flow of track circuit current 5 in the presence of a broken rail 7 through the track relay 4 via the sneak path created by the cross bonding 12, the equalizer bar 9, the impedance bond 8 and a side lead 10. In this circumstance, the track relay 4 would be falsely energized despite the presence of the broken rail. This would give rise to a hazardous situation because the broken rail would not be detected.

Figure 10:
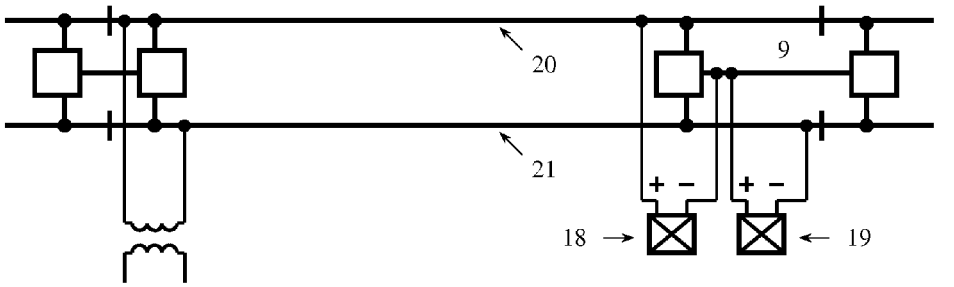
FIG. 10 shows the invention's arrangement of two track relays providing immunity from sneak paths.

The present invention overcomes the limitations of the prior art described above by the unique arrangement of two standard track relays, which each have a positive track terminal, a negative track terminal, and two local terminals. FIG. 10 illustrates this arrangement whereby the positive track terminal of the first track relay 18 is connected to one running rail 20 while the negative track terminal of the first track relay 18 is connected to the equalizer bar 9. Further, the positive track terminal of the second track relay 19 is connected to the equalizer bar 9 while the negative track terminal of the second track relay 19 is connected to the other running rail 21. The two local terminals of the first track relay and the two local terminals of the second track relay are each connected to the local power supply for voltage and phasing reference. These local terminals and the connections to the local power supply are not shown in FIG. 10.

Figure 11:
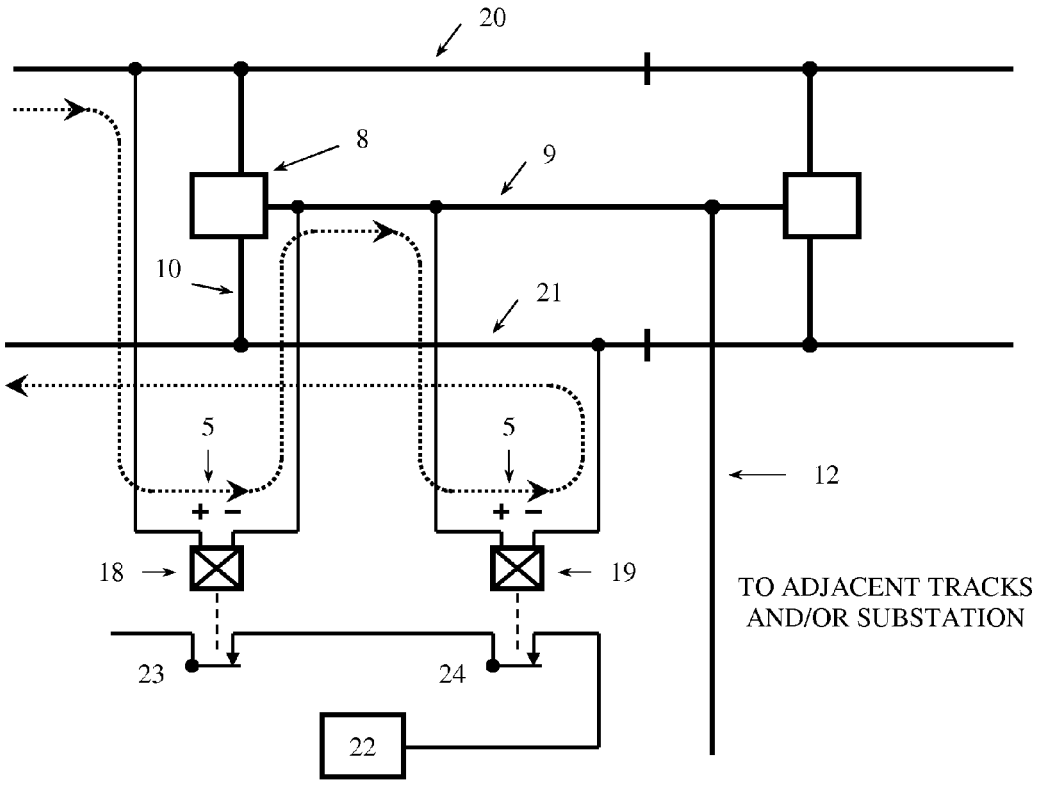
FIG. 11 shows the normal flow of current through the two track relays of the present invention.

Normal operation is illustrated in FIG. 11 wherein track circuit current 5 flows through both the first track relay 18 and the second track relay 19 in series, thereby energizing both. The circuit interfacing to the signaling or train control system 22 is wired through normally energized, or "front", contacts 23 and 24 respectively of the first and second track relays 18 and 19. Such contacts are arranged in series so that the circuit is not completed unless both track relays 18 and 19 are energized. The presence of energy on this circuit at the interface to the signaling or train control system 22 corresponds to conditions where 1) the track circuit is vacant and 2) there is no broken rail within it.

Figure 12:
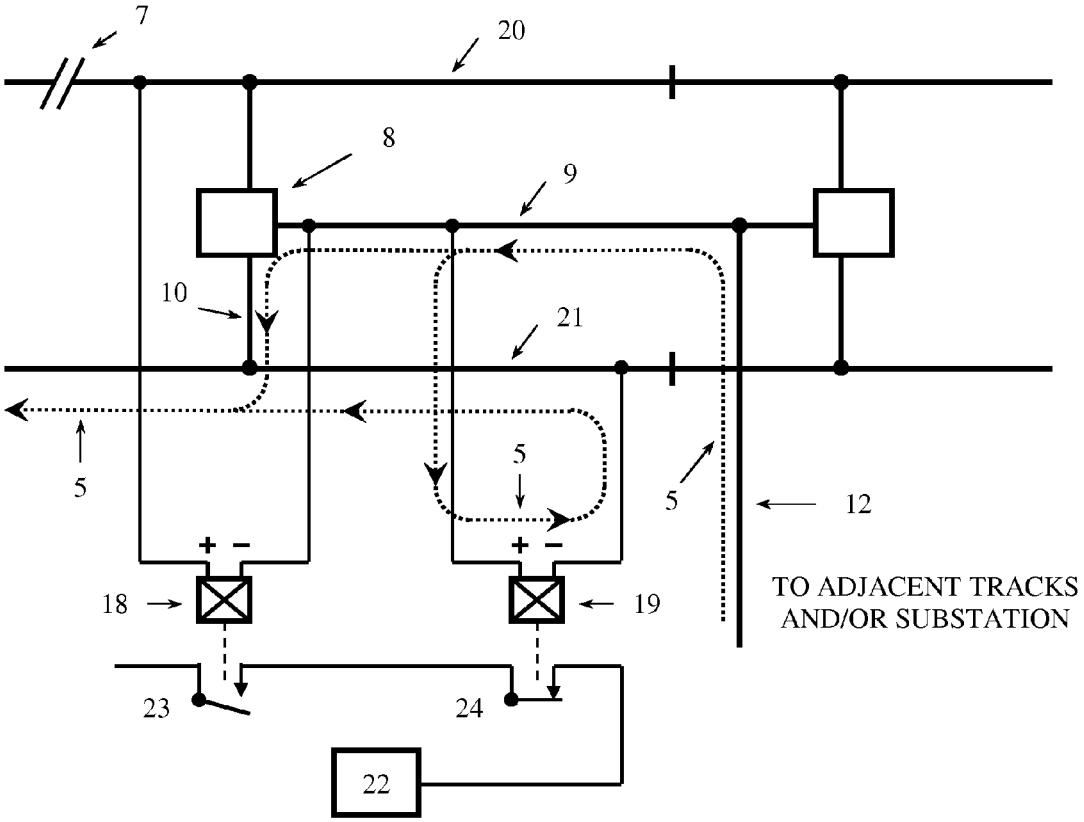
FIG. 12 shows the flow of current through one of the two track relays of the present invention in a track circuit with a broken rail.

Operation in the presence of a broken rail is depicted in FIG. 12. The rail break 7 is located on the first running rail 20. Track circuit current 5 flows through the cross bonding 12 and the equalizer bar 9 as it had in FIG. 9. Due to the rail break 7 no current can flow along the first running rail 20. The impedance bond 8 and second track relay 19 now form a parallel circuit between the equalizer bar 9 and the second running rail 21. Accordingly the track circuit current splits to run through the impedance bond 8 and the second track relay 19. The reduced current flowing through the second track relay 19 may or may not be sufficient to energize it. However this is of no consequence. It is readily seen that because of the rail break 7 no current will flow through the first track relay 18. Therefore, even in the event that the second track relay 19 is energized, the first track relay 18 is assured to be de-energized. The front contact 23 of the first track relay 18 is thereby assured to be open, thereby de-energizing the interface circuit to the signaling or train control system 22 and ensuring protection for trains.

From the foregoing, it will be appreciated that various embodiments of the present disclosure have been described herein for purpose of illustration, and that various modifications can be made without departing from the scope and spirit of the present disclosure. Accordingly, the various embodiments disclosed herein are not intended to be limiting, with the true scope and spirit being indicated by the following claims.

The invention claimed is:

1. A railroad track circuit for electrified territory to be applied to an electrically isolated section of track with a first end and a second end and a first and second running rail running between the first end and the second end, the railroad track circuit providing positive broken rail detection despite a presence of sneak paths caused by negative return cross bonding, the railroad track circuit comprising:

a. a first track relay having a positive and a negative track terminal and two local terminals, the positive track terminal of the first track relay being connected to the first running rail at the first end of the electrically isolated section of track, the negative track terminal of the first track relay being connected to an equalizer leg of an impedance bond located at the first end of the electrically isolated section of track, and the two local terminals of the first track relay being connected to a local power supply for voltage and phasing reference;

b. a second track relay having a positive and a negative track terminal and two local terminals, the positive track terminal of the second track relay being connected to the equalizer leg of the impedance bond located at the first end of the electrically isolated section of track, the negative track terminal of the second track relay being connected to the second running rail at the first end of the electrically isolated section of track, and the two local terminals of the second track relay being connected to the local power supply for voltage and phasing reference; and c. an energy source fed from the local power supply, the terminals of the energy source being connected to the first and second running rails at the second end of the electrically isolated section of track.

2. The track circuit of claim 1 wherein the first track relay further comprises means to notify a signaling or train control system of a broken rail within the first running rail.

3. The track circuit of claim 1 wherein the second track relay further comprises means to interface to a signaling or train control system of a broken rail within the second running rail.

4. The track circuit of claim 1 whereby broken rail detection is also provided despite a presence of sneak paths caused by ground connections between adjacent substations or other grounding sites.

5. The track circuit of claim 2 whereby broken rail detection is also provided despite a presence of sneak paths caused by ground connections between adjacent substations or other grounding sites.

6. The track circuit of claim 3 whereby broken rail detection is also provided despite presence of sneak paths caused by ground connections between adjacent substations or other grounding sites.

* * * * *